US008845813B2

(12) United States Patent
Pers et al.

(10) Patent No.: US 8,845,813 B2
(45) **Date of Patent: *Sep. 30, 2014**

(54) WASHER, SUCH AS A DISHWASHER OR A WASHING MACHINE, AND METHOD FOR OPERATING A WASHER

(75) Inventors: Per-Erik Pers, Mora (SE); Sarah Forster, Stockholm (SE); Niklas Olson, Stockholm (SE)

(73) Assignee: Electrolux Home Products Corporation N.V., Brussels (BE)

( * ) Notice: Subject to any disclaimer, the term of this patent is extended or adjusted under 35 U.S.C. 154(b) by 114 days.

This patent is subject to a terminal disclaimer.

(21) Appl. No.: 13/388,862

(22) PCT Filed: Jul. 30, 2010

(86) PCT No.: PCT/EP2010/004658

§ 371 (c)(1),
(2), (4) Date: Feb. 3, 2012

(87) PCT Pub. No.: WO2011/015313

PCT Pub. Date: Feb. 10, 2011

(65) Prior Publication Data

US 2012/0125369 A1 May 24, 2012

(30) Foreign Application Priority Data

Aug. 5, 2009 (EP) ..... 09010108

(51) Int. Cl.
*B08B 7/04* (2006.01)
*A47L 15/00* (2006.01)
*A47L 15/42* (2006.01)

(52) U.S. Cl.
CPC ..... *A47L 15/0031* (2013.01); *A47L 2501/26* (2013.01); *A47L 2501/02* (2013.01); *A47L 2401/14* (2013.01); *A47L 2501/01* (2013.01); *A47L 15/0089* (2013.01); *A47L 2401/09* (2013.01); *A47L 15/4217* (2013.01); *A47L 2501/30* (2013.01); *A47L 15/0023* (2013.01); *A47L 2501/32* (2013.01)
USPC ..... 134/18; 134/25.2; 134/56 R; 134/56 D; 134/57 D; 134/58 D

(58) Field of Classification Search
CPC ..... A47L 15/0089; A47L 2401/00
USPC ..... 134/18, 25.2, 56 R, 56 D, 57 D, 58 D
See application file for complete search history.

(56) References Cited

U.S. PATENT DOCUMENTS 3,698,406 A * 10/1972 Sato et al. ..... 134/57 D
3,885,580 A * 5/1975 Cushing ..... 134/57 D (Continued)

FOREIGN PATENT DOCUMENTS

CN 1833599 A 9/2006
CN 2933277 Y 8/2007

(Continued)

OTHER PUBLICATIONS

International Search Report for International Application No. PCT/EP2010/004658, mailed Dec. 2, 2010.

(Continued)

*Primary Examiner* — Bibi Carrillo
(74) *Attorney, Agent, or Firm* — Alston & Bird LLP

(57) ABSTRACT

The invention relates to a method for operating a washer which comprises a washing chamber for accommodating goods to be cleaned, said washing chamber having in its lower portion a sump for collecting water during operation of the washer, a water inlet connected to a water tank, preferably to a water tank that is integrally, still preferably detachably, formed with the dishwasher, a pump for circulating water through the washing chamber, and a control unit for controlling a washing process carried out by the washer. In accordance dance with a first embodiment of the method of the invention, in this method: water is fed from the tank into the sump by the action of the hydrostatic pressure prevailing within the tank; the pressure within the sump or close to the sump is measured; and based on the pressure measurement the speed of the water flow is monitored and the filling level of the tank is determined, and at least one parameter and/or step of the washing process is controlled and/or indicator signals are issued to a user of the washer.

16 Claims, 2 Drawing Sheets

(56) References Cited

U.S. PATENT DOCUMENTS

| | | | | |
|---|---|---|---|---|
| 6,418,943 | B1 | 7/2002 | Miller | |
| 2004/0099287 | A1* | 5/2004 | Shin | 134/18 |
| 2012/0312325 | A1* | 12/2012 | Gnadinger et al. | 134/18 |

FOREIGN PATENT DOCUMENTS

| | | | |
|---|---|---|---|
| CN | 101401717 | A | 4/2009 |
| DE | 1503761 | A1 | 4/1969 |
| DE | 44 38 295 | A1 | 7/1996 |
| DE | 4400877 | C2 | 7/1997 |
| DE | 102 46 017 | A1 | 4/2004 |
| DE | 103 14 892 | A1 | 10/2004 |
| DE | 20 2006 00256 | U1 | 4/2006 |
| DE | 10 2004 057 019 | A1 | 6/2006 |
| EP | 0 080 948 | A1 | 6/1983 |
| EP | 0 546 434 | A1 | 6/1993 |
| EP | 0 569 733 | A1 | 11/1993 |
| EP | 1 358 833 | A2 | 11/2003 |
| EP | 1 464 268 | A2 | 10/2004 |
| EP | 2 009 408 | A2 | 12/2008 |
| FR | 2 499 396 | A1 | 8/1982 |
| WO | WO 2004/023967 | A1 | 3/2004 |

OTHER PUBLICATIONS

International Search Report for International Application No. PCT/EP2010/004659, mailed Feb. 16, 2011.

* cited by examiner

WASHER, SUCH AS A DISHWASHER OR A WASHING MACHINE, AND METHOD FOR OPERATING A WASHER

CROSS REFERENCE TO RELATED APPLICATIONS

This application is a national stage application filed under 35 U.S.C. 371 of International Application No. PCT/EP2010/004658, filed Jul. 30, 2010, which claims priority from European Patent Application No. 09010108.0, filed Aug. 5, 2009, each of which is incorporated herein in its entirety.

BACKGROUND

The present invention relates to a washer, such as a dishwasher or a washing machine, comprising a washing chamber for accommodating goods to be cleaned, said washing chamber having in its lower portion a sump for collecting water during operation of the washer, a water inlet connected to a water tank, preferably a water tank that is integrally, preferably detachably, formed with the washer, a circulating pump for circulating water through the washing chamber, and a control unit for controlling a washing process carried out by the washer. The present invention further relates to a method for operating such a washer.

While the majority of the dishwashers and washing machines which presently are on the market are designed to be permanently connected to a continuously provided water supply, such as in a domestic household to a tap which when opened continuously feeds water, in recent years washers were developed which are supplied with water from a water supply tank, such as a relatively small tank, which is designed to be filled prior to any automatic program cycle carried-out in the washer under the control of a control unit of the washer and which is integrated into the washer or is designed as an external tank to which the washer is connected. Such washers thus are particularly suited for small households, in which only small amounts of articles are to be cleaned, for mobile devices such as motor homes, camper vans, yachts and the like, or households which are not permanently supplied with running water and in which, in order to be able to supply water at all times, a central tank is installed in the house, which feeds a plurality of user sites within the house.

While the present invention can be used to any kind of washer, such as dishwashers or washing machines for washing clothes, in the following it will be described in connection with dishwashers.

An example for such a washer is shown in DE 10 2004 057 019 A1 which describes a water supplied domestic appliance, in particular, a dishwasher, which is connected to an integrated tank, which is filled with an amount of water as it is required for a program cycle. The water from the tank is fed to the sump within the washing chamber of the dishwasher either by means of a feed pump which is connected to the water supply system of the dishwasher or is fed to the sump by the action of the hydrostatic pressure prevailing within the tank.

SUMMARY

It is an object of the present invention to provide for a washer of the afore-mentioned type and a method for operating such washer, which provide for further operating comfort for the user.

The above object is solved by the present invention in that according to claim 16 in a washer of the afore-mentioned type, wherein the water tank is integrally, preferably detachably, formed with the washer, the tank is arranged to feed water via a water inlet into a sump of the washer by the action of the hydrostatic pressure prevailing within the tank, in that a pressure sensor which is located in the sump or close to the sump, such as within a tube connecting to the sump, and an output of which is connected to a control unit of the washer, and in that the control unit is adapted to modify or terminate a the program cycle of the washer and/or to output indicator signals to a user of the washer based on signals received from the pressure sensor.

Preferably, the integrated tank is adapted to take up an amount of water that is essentially limited to the amount of water need to execute a single program cycle. The latter is an advantage in a small portable washer of the invention. The integrated tank of the washer can be formed in one piece with the washer, however preferably the integral tank is detachably connected with the washer. The detachable tank has the advantage that it can be taken off the washer and carried easily to a water tap for refilling. The latter is particularly easy for a small tank that is adapted to take up an amount of water that is essentially limited to the amount of water need to execute a single program cycle.

At least one pressure sensor is provided in the washer. The pressure sensor can be arranged to measure the water pressure on the suction side, preferably within an inlet conduit of the circulation pump, and/or on the pressure side, preferably within an outlet conduit of the circulation pump, of the circulation pump of the washer. Preferably, the pressure sensor is arranged on the suction side of the circulation pump, in particular within an inlet conduit of the circulation pump, which has the advantage that the pressure sensor is arranged in direct communication with the sump which is most suitable for measuring the water level in the sump during initial filling of the sump with water at the start of a program cycle. It is preferred to do the initial filling with water while the circulation pump is still switched off. Also, it is preferred to monitor the initial filling process by executing a multitude of at least two preferably more subsequent pressure measurements. Of course the measurements during initial water filling of the sump are also possible, if the pressure sensor is arranged on the pressure side of the circulation pump. However, then the water must be able to pass first through the circulation pump in order to reach the pressure sensor, which however is readily possible with most pumps. With advantage, an analog pressure sensor, such as is described for example in DE20200600256U1, can be used, because it can provide repeated readings that closely follow the changes of the water pressure within the sump during the program cycle, in particular during the initial filling of the sump with water and/or during the operation of the circulation pump.

In a method of the invention according to claim 1 for operating a washer of the afore-mentioned type, the above object is solved in that in the method water is fed from the tank into the sump by the action of the hydrostatic pressure prevailing within the tank, the pressure within the sump or close to the sump is measured, and, based on the pressure measurement the speed of the water flow is monitored and the filling level of the tank is determined, and at least one parameter and/or step of the washing process is controlled and/or indicator signals are issued to a user of the washer.

Whereas in principle the water supply tank of the washer as used in the method of the invention can be of any size and can be a large central tank which supplies several users and their respective washer, it is preferred that the washer comprises an integrated tank. Still further preferred the water tank has a volume which corresponds essentially to the amount of water required for executing a single program cycle.

Whereas in such method and washer no feed pump is required to feed water from the tank into the sump, so that the method and washer can be designed to be more compact and simple, on the other hand a pressure sensor, preferably an analog pressure sensor, is used, which is located in the sump or close to the sump and an output of which is connected to the control unit and which provides measurements that are indicative for various conditions prevailing within the washer. Using these pressure measurements, the washing process is controlled and/or indicator signals are issued to the user, which thus provides for further ease of use and which also increases the reliability and safety of the washer.

In a first embodiment of the method of the present invention a plurality of predetermined pressure values are assigned to different washing programs and/or to different stages within a washing program. The pressure in the sump or close to the sump is measured during feeding water into the sump, and the measured values are compared with the pre-stored values. Based upon this comparison, a washing program or stage of a washing program is selected.

In this embodiment there is provided for an automatic adaptation of the washing program, which is made in dependency of the pressure within or close to the sump. In this manner, for example in order to differentiate between an intensive washing program in which more water is required, and a short program which uses less water, the user simply can fill the appropriate amount of water into the tank and then the machine will automatically select the proper washing program, without the user having to make any selections such as pushing buttons or the like to make such adjustment. Similarly, should the user inadvertently have filled in a smaller amount of water then would have been required for an intended washing program, or should only a portion of the water filled into the tank be transferred from the tank into the sump, the method will automatically select a different washing program which is designed for the amount of water which actually has been reached the sump of the machine.

In a second embodiment of the method of the present invention a plurality of predetermined values is stored which are assigned to different washing programs and/or to different stages within a washing program. The pressure within the sump or close to the sump is measured at given times within the program cycle carried-out in the washer, which measured values then are compared with the values that were stored for the respective washing program, so as to determine whether sufficient water is available to proceed with the instantaneous program cycle. Should the comparison indicate that there is not sufficient water to continue or to complete the program cycle, the program cycle is interrupted and/or a warning message is generated so as to give the user the possibility to fill up the tank so that the program cycle can be completed.

This embodiment of the method of the present invention prevents that a program cycle is carried out with too little water to provide for a satisfactory washing result and/or to enable proper functioning of the machine. Since in washers, which are not connected to a continuous water supply, but which are supplied with water from a tank, the volume of water which can be fed into the washing chamber is limited, in certain cases the water level can drop to a level at which operation of the machine should be interrupted. For example, if in a dishwasher a glass or cup that is to be cleaned inadvertently is turned upside up during the washing process, the glass or cup may completely fill with water which thus is missing in the water to be circulated within the washing chamber. This problem may be amplified by soil which takes up large amounts of water, which thus is bound and cannot be circulated through the washing chamber.

In the method suggested herein, therefore data of how much water is required for each phase in each program cycle is stored as a cycle profile which can be retrieved by the control system. As soon as it is determined that instantaneously the water level is too low to continue the program cycle, the cycle is interrupted and a warning message is generated. In this manner no time, energy or water is wasted on a cycle which else could not be completed correctly.

In order not to have to start a new program cycle and hence repeat the already performed cycle, the method preferably monitors for a predetermined time interval whether the tank has been refilled and resumes the program cycle, if it is determined that the tank has been sufficiently refilled. Should this not be the case, for example because the user has left the house or went to bed and hence cannot take note of the warning message, the method terminates the program cycle.

While the pressure measurements can be used in various ways, in a further preferred embodiment of the method of the present invention the pressure is measured within the sump or close to the sump during feeding water into the sump. Values measured during feeding water into the sump are stored to be later compared with values which are measured during draining water from the sump. The differential value obtained by such comparison then is evaluated so as to check whether it is within a predetermined range in order to determine whether draining has been complete, which is particularly important in a dishwasher that uses a small amount of water, such as a dishwasher that comprises its own water tank. Should the differential value be outside the predetermined range, the draining is terminated and/or indicator signals are issued.

This embodiment of the method of the present invention makes use of the fact that the pressure difference experienced within the sump during filling should roughly correspond to the pressure difference that is established during draining of the sump. That is, except for a minor amount of water which adheres to the articles to be cleaned or the internals of the washing chamber the water filled into the machine should correspond to the water that is drained from the machine. When establishing a predetermined range for the differential value between a measurement obtained during feeding and a measurement obtained during draining, preferably a certain margin is included for water which typically is "lost" during the washing process.

Should the differential value obtained by such method be outside the predetermined range, the draining is terminated and/or indicator signals are provided to a user so that he can check whether, for example, the drain is blocked or whether the drain tube is properly connected. The latter may be particularly helpful, if the washer is not permanently installed, but rather is designed as a portable unit, wherein the drain tube which needs to be properly placed, for example, in a sink. Furthermore, this method also can be used to detect leaks in the water feeding lines.

The indicator signals can be provided, for example, as an optical and/or acoustic warning message such as a light, which begins flashing, an alpha-numerical message which displayed on a display of the washer or as an acoustic signal such as a continuous or intermittent beep tone.

By the above embodiment of the method of the present invention it can be ascertained that the draining is properly and completely effected, which particularly in devices, in which only a relatively small amount of water is used, is of major importance, so as to avoid that soil or chemicals, which are present in a first program cycle remain within the machine and thus could spoil a subsequent program cycle.

In a third preferred embodiment of the method of the present invention for operating a washer which comprises a water tank that is integrally, preferably detachably, formed with the washer, the pressure within the sump or close to the sump is measured by a pressure sensor during feeding water into the sump, which measured values then are compared with a predetermined value so as to obtain a differential value and wherein the feeding of water into the sump is terminated and/or indicator signals are issued to a user, should it be determined that the differential value is below a predetermined value. This embodiment of the method of the present invention thus makes use of the fact that as the water is passed from the tank to the sump due to the hydrostatic pressure within the tank, the speed of the water flow is proportional to the height of the water level within the tank. In this method, the speed of the water flow is monitored by measuring the pressure within the sump or close to the sump, for example, within a tube connecting to the sump such as the inlet conduit of a circulation pump by means of which water which has collected in the sump is fed to a rotating spray arm. By monitoring the speed of the water flow, conclusions as regards the water level in the tank as well as regards the water level within the sump can be made.

For example, if for a washing level it is required that the tank is completely filled, a predetermined value can be chosen which corresponds to the pressure that is experienced with a fully filled tank. This can be practically executed for example in that during an initial filling phase of the washer sump with water, wherein preferably the circulation pump remains switched off, a plurality of at least two measurements with the pressure sensor are executed and their values as well as the time between the measurements is received, recorded and evaluated by the control unit of the washer using a simple calculation such is readily known to the skilled person, and thus the actual pressure change over time is determined. The resulting measured value can then be compared by the control unit with such predetermined value, for example, by subtracting the two values, in the ideal case a difference of zero would result. Since such measurement typically will be subject to some variation and measuring inaccuracy, it is preferred to allow for a certain predetermined range within which the differential value should fall. If it is determined, that the differential value is outside such predetermined range, the feeding of water into the sump is terminated and/or indicator signals are generated, so that the user can check, for example, whether the tank is correctly filled, or should the tank be designed to be removable, whether the tank is correctly connected to the dishwasher, whereupon the program cycle can be resumed or restarted.

Thus, in order to provide for reference values with which the measured values can be compared so as to obtain the differential value, a calibration step can be carried-out, in which the water tank is completely filled and the pressure within the sump or close to the sump when feeding into the sump is measured.

Alternatively, particularly if the method is applied to evaluate the level within the sump, a calibration step can be carried-out in which the pressure within the sump or close to the sump is determined before water is fed into the sump that is, while the machine still is dry or relatively dry.

Preferably, a plurality of predetermined pressure values is assigned to different washing programs and/or to different stages within a washing program, wherein one of these predetermined values, which corresponds to the instantaneous washing program and/or to the instantaneous stage within the washing program, is retrieved to be used in the evaluation of the measured value. Thus, the method and system can automatically adapt to the pertinent situation prevailing without the user having to make any further adjustments.

In the third embodiment of the method of the present invention, it further is preferred that the feeding of water into the sump is paused, if it is determined that a predetermined filling level of the sump has been reached which is less than the level of the sump when completely filled, and wherein after expiry of a predetermined waiting period the feeding of water into the sump is resumed to complete the filling of the sump. Pausing the filling and waiting for a certain time period, such as, for example, ten to twenty seconds, has the advantage that the water that has been fed into the washing compartment can settle and accumulate within the sump, so that in can be ascertained more accurately how much is required to complete the filling. In this manner, the water consumption of the washer can be further decreased, because it is effectively prevented that more water than actually needed is fed into the machine. Thus, the method and system can compensate for different operational states, for example, differences that else would occur between on the one hand using the machine from the dry state, i.e. when the machine was not in use for some time, and on the other hand when the machine is started when it is still wet from a preceding program cycle.

Since during feeding water into the sump the surface of the water within the sump may oscillate, which may lead to measurement errors, preferably the majority of the water to be filled into the sump is fed into the sump, when the filling is paused. Thus, a preferred filling level when pausing the filling is in the range of from 75 to 95% of the amount required to completely fill the sump. The third embodiment of the method of the present invention may also comprise the execution of an adaptation to cycles with different filling levels without the user having to care about it. The user only needs to fill the tank completely and place it in the washer. With the selected washing program the control unit of the washer will recognize the water level in the tank basing on the pressure sensor signal and adapt the program cycle accordingly.

In any of the above embodiments of the method of the present invention error data may be stored and a user message issued, if a predetermined number of error occurrences or a predetermined frequency of error occurrences is reached, so as to alert the user that the machine should be inspected.

It is to be understood that while the method of the present invention could be designed to carry out the routines described above in either one of the exemplified embodiments, the washer and the method for operating the same preferably is designed to carry out the routines of more than one or of all these embodiments.

BRIEF DESCRIPTION OF THE DRAWINGS

An example of a washer made in accordance with the teachings of the present invention will be described below by reference to drawings, in which.

DETAILED DISCUSSION

Figure 1:
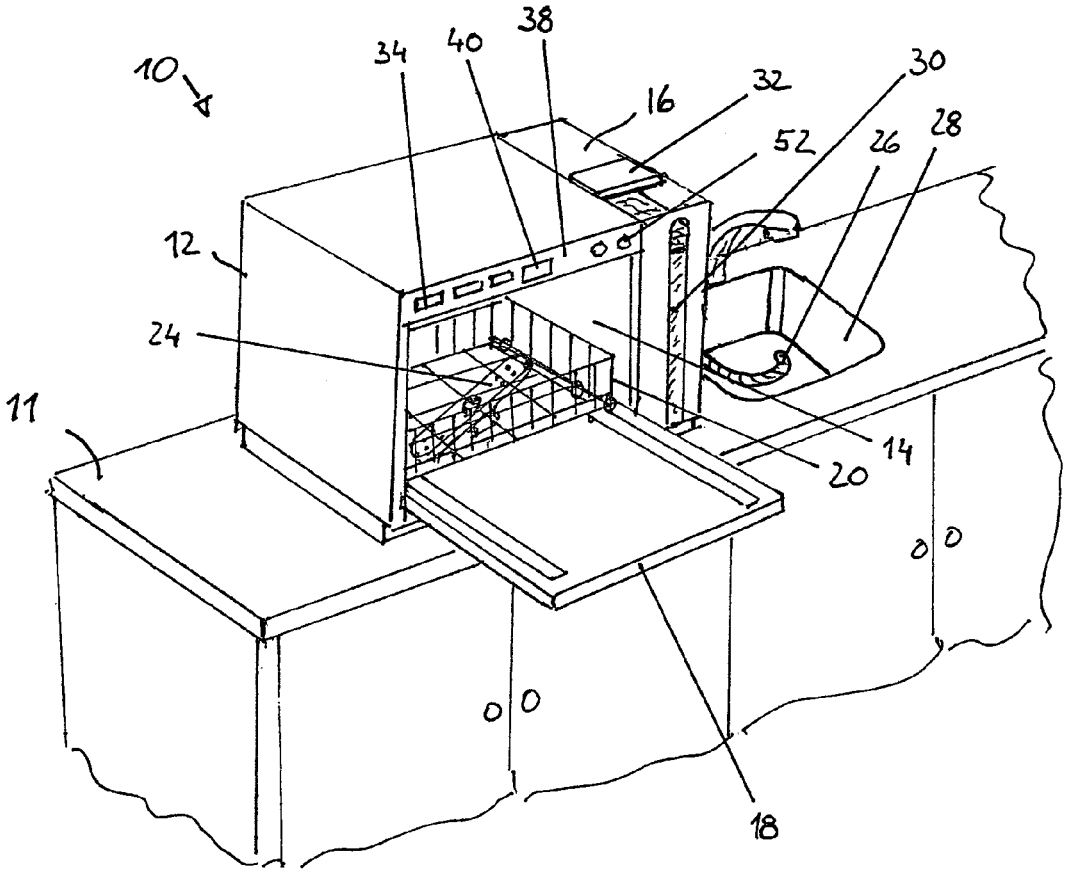
FIG. 1 is a perspective view of a dishwasher in accordance with the present invention.

FIG. 1 shows a dishwasher 10, which can be placed on top of a kitchen console 11 or which also could be used as a portable device for use, for example, within a camper van or yacht.

Dishwasher 10 which is designed to be placed on a kitchen console 11 comprises a housing section 12 and a tank section 16 into which a volume of the water is filled as it is required for an intended washing operation. In order to access the washing chamber, housing section 12 is provided with a door 18, which is tiltable about a vertical axis and which in the usual manner constitutes in its open state a support surface, on which a basket 20 can be placed, which holds any goods to be cleaned. Within the lower section of the washing chamber 14 there is provided a sump 22, in which water that is sprayed onto the goods to be cleaned by means of a rotatable spray arm 24 collects, to be again sprayed onto the goods to be cleaned.

Figure 2:
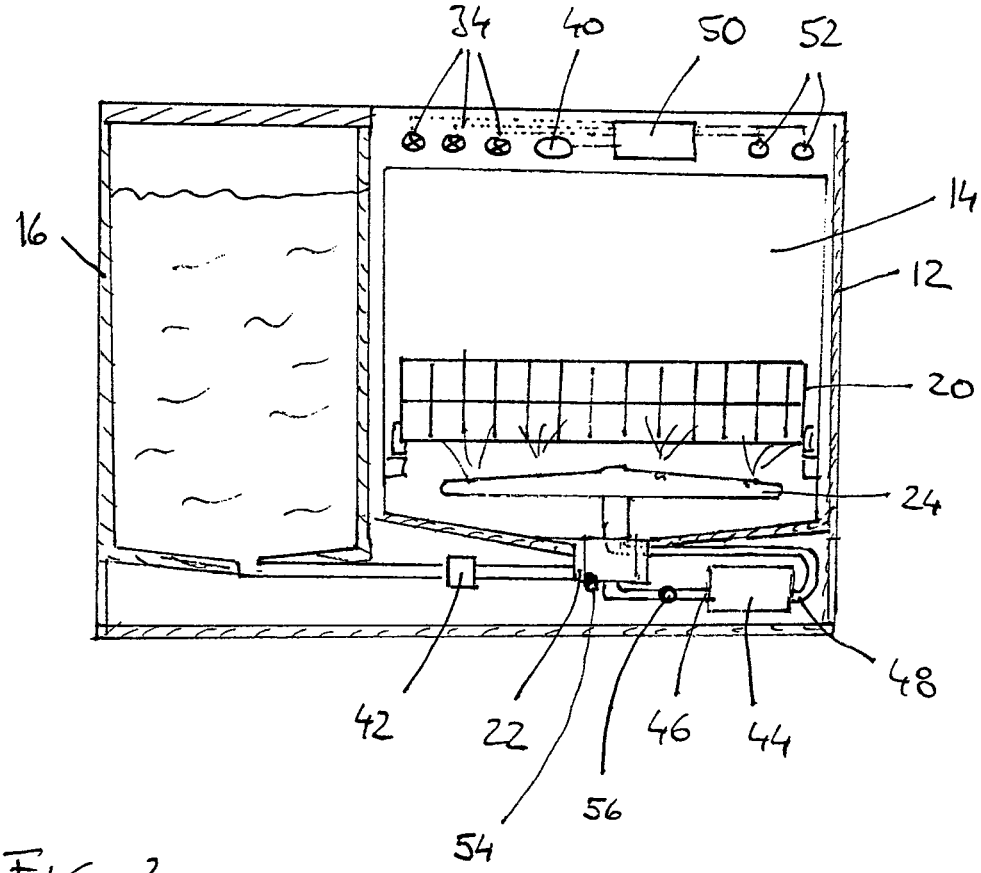
FIG. 2 is a schematic sectional view of the dishwasher of FIG. 1.

Water flows into the sump from tank 16 via a water inlet 42 (shown in FIG. 2 only) that is located at a level below the floor of the tank, so that the water is passed from the tank into the sump solely by the action of the hydrostatic pressure prevailing within tank 16. Sump 22 is connected to an inlet opening 46 for a circulation pump 44 (see FIG. 2) the outlet 48 of which feeds water to the rotatable spay arm 24. Any water which no longer is required for the washing process can be drained to waste via a drain conduit 26, the free end of which can be arranged temporarily within a sink 28 or could be connected permanently for example to a drain pipe of sink 28.

As shown in FIG. 1, tank 16 can be equipped with a window 30 through which the filling level of tank 16 is visible also when the lid 32 of tank 16 is closed. At the front side of the closed door or, as shown in the drawing, at a front panel 38 provided at the front side of housing section 12 there are provided a plurality of indicator lamps 34 by means of which a variety of operational states or warning messages can be issued to a user of the washing machine. Alternatively or additionally, acoustic indications can be provided by means of a speaker 40 which is provided within front panel 38.

Operation of the dishwasher is effected by means of a control unit 50 (see FIG. 2) which is adapted to carry out the various methods described above, and which operates the dishwasher in dependency of user inputs, such as settings made at selector switches 52, and sensor signals, such as the signal provided form a pressure sensor 54 which is located within the sump or a pressure sensor 56 which is located close to the sump, such as in the feed conduit to the circulation pump 44.

LIST OF REFERENCE SIGNS

10 dishwasher
11 kitchen console
12 housing section
14 washing chamber
16 tank section
18 door
20 basket
22 sump
24 spray arm
26 drain conduit
28 sink
30 window
32 lid
34 indicator lamps
38 front panel
40 speaker
42 water inlet
44 circulation pump
46 inlet opening
48 outlet
50 control unit
52 selector switch
54 pressure sensor
56 pressure sensor

The invention claimed is:

1. A method for operating a washer which comprises a washing chamber for accommodating goods to be cleaned, said washing chamber having in its lower portion a sump for collecting water during operation of the washer, a water inlet connected to a water tank that is detachably formed with the washer, a pump for circulating water through the washing chamber, and a control unit for controlling a washing process carried out by the washer, comprising:

feeding water from the tank into the sump by the action of hydrostatic pressure prevailing within the water tank;

measuring water pressure within the sump or close to the sump by a pressure sensor; and based on the water pressure measurement:

monitoring a speed of water flow within at least one of the sump or close to the sump;

determining a fill level of the tank; and controlling at least one parameter and/or step of the washing process and/or issuing indicator signals to a user of the washer.

2. The method of claim 1, wherein the water tank has a volume corresponding essentially to an amount of water required for executing a single program cycle.

3. The method of claim 1, comprising in subsequent steps:

(a) storing a plurality of predetermined water pressure values which are assigned to different washing programs and/or to different stages within a washing program, (b) measuring the water pressure within the sump or close to the sump during feeding of the water into the sump;

(c) comparing the values measured in step (b) with the values stored in step (a); and (d) selecting a washing program or stage within a washing program based on the comparison of step (c).

4. The method of claim 1, comprising in subsequent steps:

(a) storing a plurality of predetermined water pressure values which are assigned to different washing programs and/or to different stages within a washing program, (b) measuring the water pressure within the sump or close to the sump at given times within a program cycle carried out in the washer;

(c) comparing the water pressure values measured in step (b) with the values stored in step (a) to determine whether sufficient water is available to proceed with an instantaneous program cycle; and (d) interrupting the program cycle and/or issuing a warning message to the user when the comparison of step (c) indicates that there is not sufficient water available to proceed with the instantaneous program cycle.

5. The method of claim 1, further comprising in subsequent steps:

(a) measuring the water pressure within the sump or close to the sump during feeding of the water into the sump and storing the measured values;

(b) measuring the water pressure within the sump or close to the sump during draining water from the sump;

(c) comparing the values measured during feeding water with those measured during draining to obtain a differential value;

(d) evaluating whether the differential value obtained in step (c) is within a predetermined range; and (e) terminating the draining and/or issuing indicator signals to a user if in step (d) it is determined that the differential value is outside the predetermined range.

6. The method of claim 1, further comprising storing error data and issuing a user message if a predetermined number or frequency of error occurrences is reached.

7. The method of claim 4, further comprising in subsequent steps:

(e) monitoring for a predetermined time interval whether the water tank is refilled;

and (f) resuming the program cycle if the water tank is sufficiently refilled within the predetermined time interval, or terminating the program cycle if the water tank is not sufficiently refilled within the predetermined time interval, wherein the water tank is sufficiently refilled if there is sufficient water available to proceed with the instantaneous program cycle.

8. The method of claim 5, in which step (e) an optic and/or acoustic warning message is generated.

9. A method for operating a washer which comprises a water tank that is detachably formed with the washer, a washing chamber for accommodating goods to be cleaned, said washing chamber having in its lower portion a sump for collecting water during operation of the washer, a water inlet connected to the water tank for feeding water from the water tank into the sump, a pump for circulating water through the washing chamber, and a control unit for controlling a washing process carried out by the washer, the method comprises:

(a) feeding water from the water tank into the sump by the action of hydrostatic pressure prevailing within the water tank;

(b) measuring water pressure within at least one of the sump or close to the sump by a pressure sensor during feeding of the water into the sump and using the measured water pressure for determining a fill level of the water tank;

(c) comparing at least one value of the measured water pressure in step (b) with a predetermined value to obtain a differential value; and (d) terminating the feeding of the water into the sump and/or issuing indicator signals to a user if it is determined that the differential value is outside a predetermined range.

10. The method of claim 9, in which, prior to step (b), a calibration step is carried out in which the water tank is completely filled and the water pressure within the sump or close to the sump when feeding of the water into the sump is measured so as to obtain the predetermined value for step (c).

11. The method of claim 9, in which, prior to step (b), a calibration step is carried out in which the water pressure within the sump or close to the sump is determined before water is fed into the sump so as to obtain a calibration value which is incorporated in the determination of step (c).

12. The method of claim 9, in which, prior to step (a) a plurality of predetermined water pressure values is assigned to different washing programs and/or to different stages within a washing program, and wherein prior to step (c) a predetermined water pressure value is retrieved which corresponds to an instantaneous washing program and/or an instantaneous stage within the washing program carried out in the washer.

13. The method of claim 9, in which in step (d) the feeding of the water into the sump is paused if it is determined that a predetermined fill level of the sump has been reached which is less than the level of the sump when completely filled, and wherein after expiry of a predetermined waiting period the feeding of the water into the sump is resumed to complete filling of the sump.

14. The method of claim 9, wherein the washer executes a washing program based on the filling level of the water tank.

15. The method of claim 9, further comprising storing error data and issuing a user message if a predetermined number or frequency of error occurrences is reached.

16. The method of claim 13, in which the predetermined fill level at which the feeding of water into the sump is paused corresponds to a filling of the sump of between 75 and 95 percent of the completely filled sump.

* * * * *